US007282902B2

(12) United States Patent
Chang et al.

(10) Patent No.: US 7,282,902 B2
(45) Date of Patent: Oct. 16, 2007

(54) VOLTAGE REGULATOR APPARATUS

(75) Inventors: Yuan-Hsun Chang, Kaohsiung (TW); Jia-Jio Huang, Hsinchu (TW); Cheng-Chung Chou, Taipei (TW)

(73) Assignee: Faraday Technology Corp., Hsin-Chu (TW)

( * ) Notice: Subject to any disclaimer, the term of this patent is extended or adjusted under 35 U.S.C. 154(b) by 207 days.

(21) Appl. No.: 10/708,489

(22) Filed: Mar. 7, 2004

(65) Prior Publication Data

US 2005/0194953 A1 Sep. 8, 2005

(51) Int. Cl.
*G05F 3/16* (2006.01)

(52) U.S. Cl. ..... 323/314; 323/280

(58) Field of Classification Search ..... 323/312, 323/313, 314, 274, 275, 276, 277, 280, 281; 327/530, 534, 535, 540
See application file for complete search history.

(56) References Cited

U.S. PATENT DOCUMENTS 5,689,460 A * 11/1997 Ooishi ..... 327/530
6,429,730 B2 * 8/2002 Houghton et al. ..... 327/540

* cited by examiner

*Primary Examiner*—Jessica Han
(74) *Attorney, Agent, or Firm*—Winston Hsu

(57) ABSTRACT

A voltage regulator apparatus, wherein two transistors are coupled to an output terminal of a voltage regulator, so as to improve the transient response of output voltage and increase the stability of the output voltage. Besides, it avoids the use of an external capacitor.

13 Claims, 3 Drawing Sheets

VOLTAGE REGULATOR APPARATUS

BACKGROUND OF INVENTION

1. Field of the Invention

The present invention relates generally to a voltage regulator. More particularly, the present invention relates to a voltage regulator apparatus capable of improving the transient response of the voltage regulator.

2. Description of the Related Art

To supply a constant voltage from a voltage source to a load, a voltage regulator is generally installed between the voltage source and the load.

FIG. 1 shows a conventional voltage regulator including an error amplifier 101 and an NMOS transistor 103. FIG. 2 shows another conventional voltage regulator including an amplifier 105 and a PMOS transistor 107. Both types of the foregoing conventional voltage regulators suffer from stability problems related to transient response of output voltage. As a way to improve the transient response, a capacitor is usually installed at the output terminal. However, under certain circumstances, for example, when a voltage regulator is used for multi-media card (MMC) applications, it is not desirable to use such an external capacitor for improving the transient response. Where an MMC is operated at dual voltage (e.g., 3.3 V and 1.8 V), voltage regulators are usually required to provide a stable output voltage without the use of an external capacitor. Thus, there is a problem to provide a stable output voltage while not using an external capacitor.

SUMMARY OF INVENTION

Accordingly, an object of the present invention is to provide a voltage regulator apparatus capable of improving the transient response of the output voltage so as to avoid the problems related to the use of an external capacitor at the output terminal of the voltage regulator.

To achieve the above and other objectives, the invention provides a voltage regulator apparatus including a voltage regulator, a first transistor, and a second transistor. Wherein, the voltage regulator has an output terminal and provides an output voltage regulated according to an external reference voltage. The first transistor has a first terminal coupled to the positive terminal of the voltage source, a second terminal coupled to a first bias, and a third terminal coupled to the output terminal of the voltage regulator. The second transistor has a first terminal coupled to the third terminal of the first transistor, a second terminal coupled to a second bias, and a third terminal coupled to the negative terminal of the voltage source.

In one preferred embodiment of the present invention, the voltage regulator includes an error amplifier, a third transistor, and a load circuit. The error amplifier has a positive input terminal, a negative input terminal, and an output terminal, wherein the negative input terminal is for receiving a reference voltage. The third transistor has a first terminal coupled to the positive terminal of the voltage source, a second terminal coupled to the output terminal of the error amplifier, and a third terminal outputting a regulated output voltage. The load circuit is used to divide the regulated output voltage, and provide a feedback voltage to the positive terminal of the error amplifier. The load circuit includes a first resistor and a second resistor. The first resistor has a first terminal to receive the regulated output voltage, and a second terminal to output the feedback voltage to the positive terminal of the error amplifier. The second resistor has a first terminal coupled to the second terminal of the first resistor, and a second terminal coupled to the negative terminal of the voltage source.

In one of preferred embodiment of the present invention, the third transistor of the voltage regulator apparatus is a PMOS transistor.

In one preferred embodiment of the present invention, the first transistor of the voltage regulator apparatus is an NMOS transistor, and the second transistor is a PMOS transistor.

In one preferred embodiment of the present invention, the first bias and the second bias are defined for the first and second transistors operating in a sub-threshold region.

To sum up, the voltage regulator apparatus of the present invention provides two transistors coupled to the output terminal of a conventional voltage regulator so as to improve transient response of and increase stability of the output voltage, and to avoid the use of an external capacitor.

It is to be understood that both the foregoing general description and the following detailed description are exemplary, and are intended to provide further explanation of the invention as claimed.

BRIEF DESCRIPTION OF DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION

Reference will now be made in detail to the preferred embodiments of the invention, examples of which are illustrated in the accompanying drawings.

Figure 1:
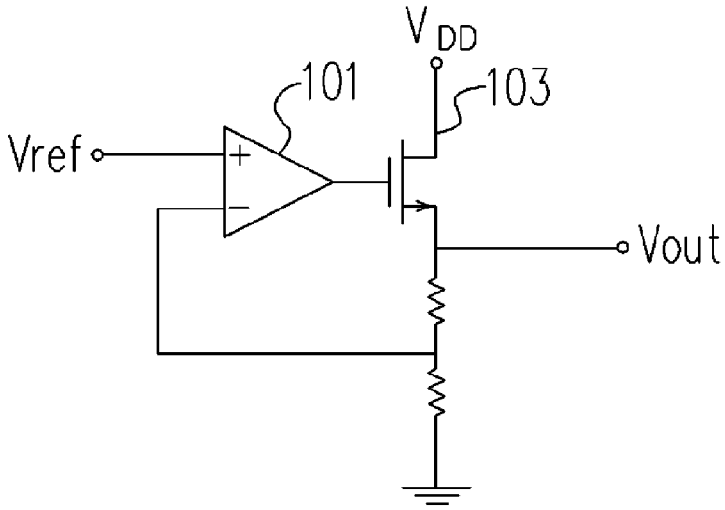
FIG. 1 (PRIOR ART)
FIG. 1 is a circuit diagram showing a conventional voltage regulator having an NMOS transistor.
Figure 2:
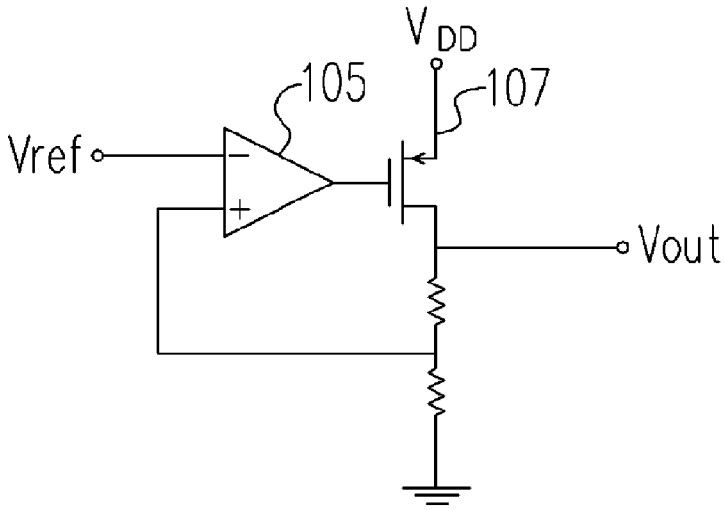
FIG. 2 (PRIOR ART)
FIG. 2 is a circuit diagram showing a conventional voltage regulator apparatus having a PMOS transistor.
Figure 3:
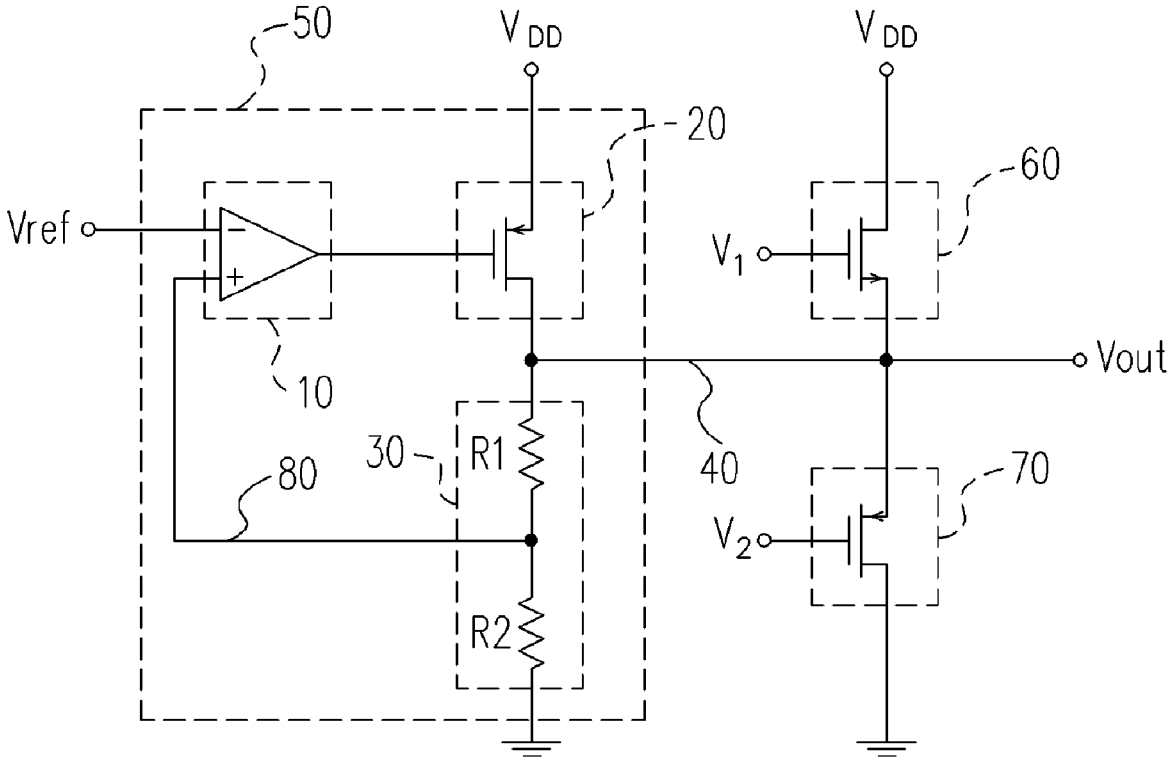
FIG. 3 is a circuit diagram showing a voltage regulator apparatus according to a preferred embodiment of the present invention.

FIG. 3 is a circuit diagram showing a voltage regulator apparatus according to a preferred embodiment of the present invention. In this preferred embodiment, a conventional voltage regulator 50 is provided, and a first transistor 60 and a second transistor 70 are coupled to the output terminal of the voltage regulator 50, so as to improve the transient response of output voltage.

The conventional voltage regulator 50, after receiving a reference voltage Vref via a negative terminal of an error amplifier 10, provides an output voltage, and, after passing a third transistor 20 and a load circuit 30, provides a regulated output voltage Vout at the output terminal 40, and simultaneously feedbacks a feedback voltage to the positive terminal 80 of the error amplifier 10. The third transistor 20 is a POMS transistor. The load circuit 30 consists of resistors R1 and R2 connected in series for dividing the regulated output voltage and providing a feedback voltage to the positive terminal of the error amplifier 10.

To improve the transient response, the voltage regulator 50, via the output terminal 40, is coupled to the first transistor 60 and the second transistor 70, while the first transistor 60 is an NMOS transistor and the second transistor 70 is a PMOS transistor. When the voltage at the output terminal 40 of the voltage regulator 50 is lower than the first bias V1 of the first transistor 60, the gate-source of the first transistor 60 has a positive bias, and the drain-source will conduct so as to increase the voltage at the output terminal 40 and make the output voltage quickly stabilized. When the voltage at the output terminal 40 of the voltage regulator 50 is higher than the second bias V2 of the second transistor 70, the gate-source of the second transistor 70 has a positive bias, and the drain-source will conduct so as to decrease the voltage at the output terminal 40 and make the output voltage quickly stabilized.

As mentioned above, the conducting of the first transistor or the second transistor trigers the increase or decrease of the output voltage Vout of the voltage regulator, and thus improve the transient response. In addition, because the reference voltage Vref has already treated through the voltage regulator 50, the bias range of the output voltage Vout would not be too high, and consequently the first bias V1 and the second bias V2 can be defined in such values that the first transistor 60 and the second transistor 70 can be operated in a sub-threshold region.

To test the effectiveness of the circuit, as described in the following, a simulating load is used to compare the transient responses at output terminals of a conventional voltage regulator and of a voltage regulator apparatus according to one preferred embodiment of the present invention.

Figure 4:
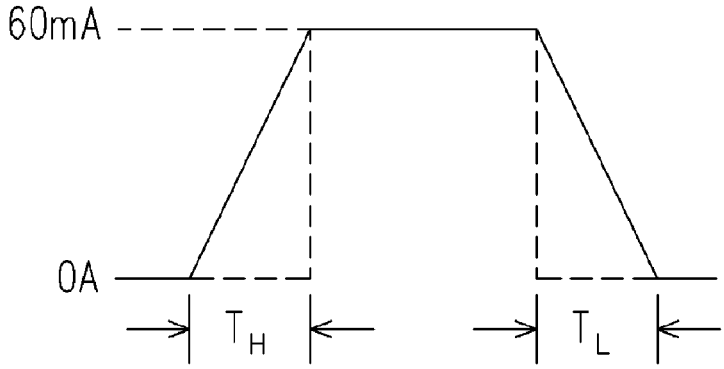
FIG. 4 is diagram schematically showing a waveform of electric current response of a simulating load.

FIG. 4 schematically shows a waveform of electric current response of a simulating load. When a load is connected to a conventional voltage regulator or a voltage regulator apparatus according to one preferred embodiment of the invention, electric current at the terminal next to the load becomes stabilized after rising over a period $T_H$ of 0.1 μs, and when the load is removed, the electric current reaches zero after discharging over a period $T_L$ of 0.1 μs.

Figure 5:
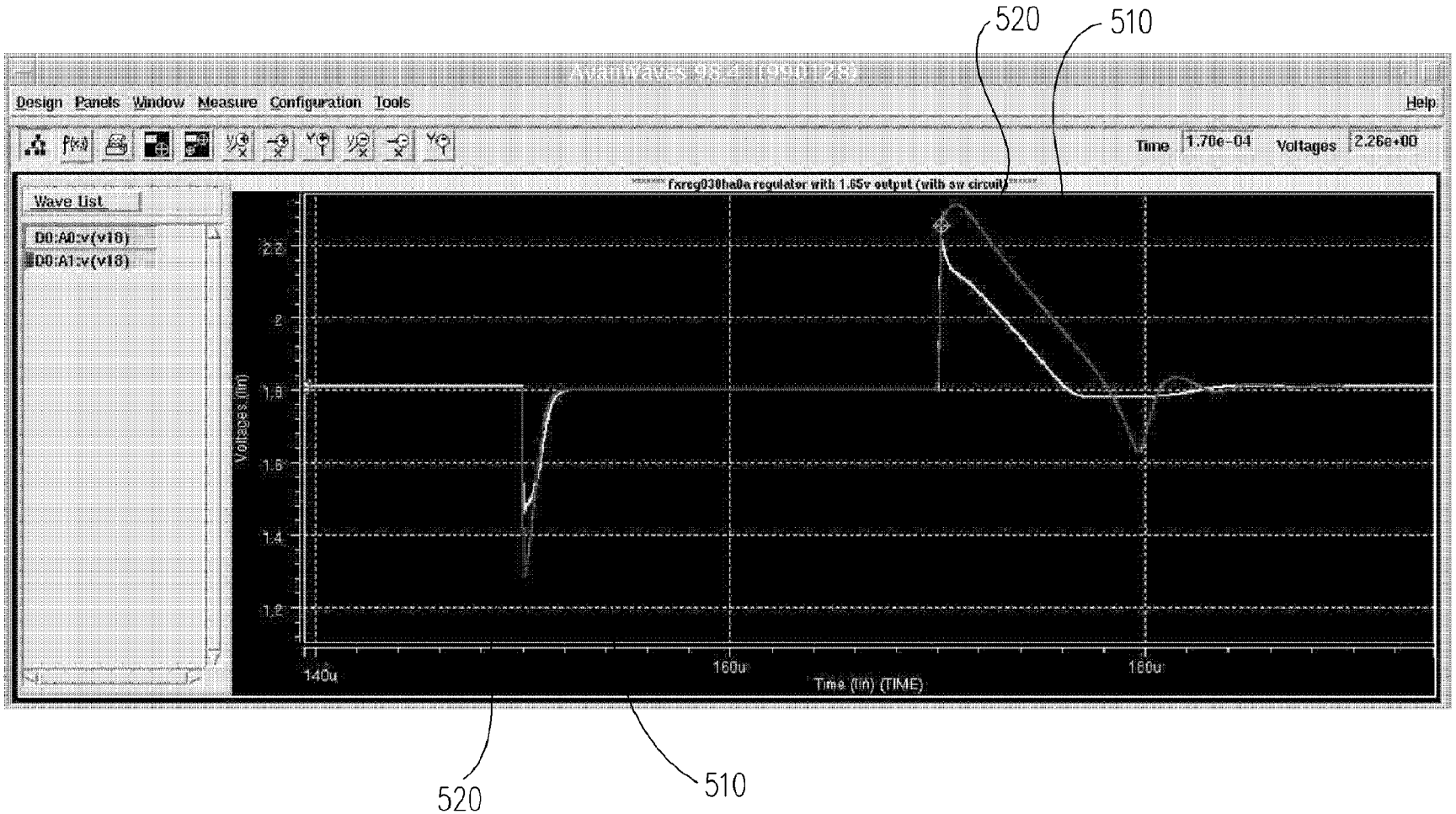
FIG. 5 is a graph comparing waveforms of transient responses of output voltage when the simulating load changes under the situations of using a conventional voltage regulator versus using a voltage regulator apparatus according to a preferred embodiment of the present invention.

FIG. 5 compares waveforms of transient responses of output voltage when the simulating load changes under the situations of using a conventional voltage regulator versus using a voltage regulator apparatus as in FIG. 4 according to a preferred embodiment of the present invention. As shown in FIG. 5, the curve 520 is an output voltage curve of a conventional voltage regulator, and the curve 510 is an output voltage curve of a voltage regulator apparatus according to a preferred embodiment of the present invention. When T=150 μs, the load is connected with the circuit, and current at the load will rise from 0 mA to 60 mA, and at the meantime, the output voltage which was stabilized at 1.8 V will drop rapidly to about 1.2 V. Subsequently, when T=152 μs, the voltage will rise back to and stabilized at a normal value. Observation of the shape changing of the two curves indicates that the fluctuation range of the output voltage curve 510 of the voltage regulator apparatus of the present invention is significantly less that that of the output voltage curve 520 of the conventional voltage regulator. When T=170 μs, the load is removed and voltage will also fluctuate, however, observation of the shape changing of the two curves indicates that the fluctuation range of the output voltage curve 510 of the voltage regulator apparatus of the present invention is again significantly less that that of the output voltage curve 520 of the conventional voltage regulator.

To sum up, the voltage regulator apparatus of the present invention provides two transistors coupled to the output terminal of a conventional voltage regulator so as to improve transient response of and increase stability of the output voltage, and to avoid the use of an external capacitor.

It will be apparent to those skilled in the art that various modifications and variations can be made to the structure of the present invention without departing from the scope or spirit of the invention. In view of the foregoing, it is intended that the present invention covers modifications and variations of this invention provided they fall within the scope of the following claims and their equivalents.

The invention claimed is:

1. A voltage regulator apparatus, comprising:

a voltage regulator having an output terminal to provide an output voltage regulated according to a reference voltage;

a first transistor having a first terminal coupled to a positive terminal of a voltage source, a second terminal coupled to a first bias, and a third terminal directly coupled to the output terminal of the voltage regulator; and a second transistor having a first terminal coupled to the third terminal of the first transistor, a second terminal coupled to a second bias, and a third terminal coupled to a negative terminal of the voltage source.

2. The voltage regulator apparatus as recited in claim 1 , wherein the voltage regulator comprises:

an error amplifier having a positive input terminal, a negative input terminal, and an output terminal, wherein the negative input terminal is for receiving the reference voltage;

a third transistor having a first terminal coupled to the positive terminal of the voltage source, a second terminal coupled to the output terminal of the error amplifier, and a third terminal outputting the regulated output voltage; and a load circuit used to divide the regulated output voltage, and provide a feedback voltage to the positive terminal of the error amplifier.

3. The voltage regulator apparatus as recited in claim 2, wherein the third transistor is a PMOS transistor.

4. The voltage regulator apparatus as recited in claim 2, wherein the load circuit comprises:

a first resistor having a first terminal to receive the regulated output voltage, and a second terminal to output the feedback voltage to the positive terminal of the error amplifier; and a second resistor having a first terminal coupled to the second terminal of the first resistor, and a second terminal coupled to the negative terminal of the voltage source.

5. The voltage regulator apparatus as recited in claim 1, wherein the first transistor is an NMOS transistor.

6. The voltage regulator apparatus as recited in claim 1, wherein the second transistor is a PMOS transistor.

7. A voltage regulator apparatus, comprising:

a voltage regulator having an output terminal to provide an output voltage regulated according to a reference voltage, the voltage regulator comprising an error amplifier for receiving the reference voltage;

a first transistor having a first terminal coupled to a positive terminal of a voltage source, a second terminal coupled to a first bias, and a third terminal directly coupled to the output terminal of the voltage regulator; and a second transistor having a first terminal coupled to the third terminal of the first transistor, a second terminal coupled to a second bias, and a third terminal coupled to a negative terminal of the voltage source.

8. The voltage regulator apparatus as recited in claim 7, wherein the error amplifier of the voltage regulator having a positive input terminal, a negative input terminal, and an output terminal, the negative input terminal being for receiving the reference voltage.

9. The voltage regulator apparatus as recited in claim 8, wherein the voltage regulator further comprises:

a third transistor having a first terminal coupled to the positive terminal of the voltage source, a second terminal coupled to the output terminal of the error amplifier, and a third terminal outputting the regulated output voltage; and a load circuit used to divide the regulated output voltage, and provide a feedback voltage to the positive terminal of the error amplifier.

10. The voltage regulator apparatus as recited in claim 9, wherein the third transistor is a PMOS transistor.

11. The voltage regulator apparatus as recited in claim 9, wherein the load circuit comprises:

a first resistor having a first terminal to receive the regulated output voltage, and a second terminal to output the feedback voltage to the positive terminal of the error amplifier, and a second resistor having a first terminal coupled to the second terminal of the first resistor, and a second terminal coupled to the negative terminal of the voltage source.

12. The voltage regulator apparatus as recited in claim 7, wherein the first transistor is an NMOS transistor.

13. The voltage regulator apparatus as recited in claim 7, wherein the second transistor is a PMOS transistor.

* * * * *